US005085342A

United States Patent [19]

Strawder

[11] Patent Number: 5,085,342

[45] Date of Patent: Feb. 4, 1992

[54] BAG SUPPORT FOR TRASH CANS

[76] Inventor: Glenn G. Strawder, 9200 Edwards Way #1116, Adelphi, Md. 20783

[21] Appl. No.: 468,157

[22] Filed: Jan. 22, 1990

Related U.S. Application Data

[63] Continuation-in-part of Ser. No. 307,912, Feb. 9, 1989, Pat. No. 4,905,853.

[51] Int. Cl.[5] ..... B65D 90/04

[52] U.S. Cl. ..... 220/404; 220/524; 220/533; 220/909

[58] Field of Search ..... 220/1 T, 400, 403, 404, 220/20, 909, 524, 532, 533

[56] References Cited

U.S. PATENT DOCUMENTS

| | | | |
|---|---|---|---|
| D. 142,274 | 8/1945 | Kohen | D58/4 |
| D. 142,275 | 8/1945 | Kohen | D58/4 |
| D. 142,649 | 10/1945 | Kohen | D58/4 |
| 1,021,872 | 4/1912 | Kingsbury | 220/503 |
| 2,625,973 | 1/1953 | Weldon et al. | 206/459 |
| 3,648,875 | 3/1972 | Lundgren | 220/404 |
| 3,720,346 | 3/1973 | Cypher | 220/533 |
| 3,856,173 | 12/1974 | Deane et al. | 220/23.83 |
| 3,893,615 | 7/1975 | Johnson | 232/43.2 |
| 3,904,218 | 9/1975 | Kostic | 280/79.2 |
| 4,114,776 | 9/1978 | Pluss | 220/531 |
| 4,418,835 | 12/1983 | Watts | 220/404 |
| 4,649,813 | 3/1987 | Kehl | 100/227 |
| 4,664,347 | 5/1987 | Brown et al. | 248/97 |
| 4,729,489 | 3/1988 | Papaianni | 220/23.8 |
| 4,735,340 | 4/1988 | Preston | 220/404 |
| 4,750,638 | 6/1988 | Sosower | 220/404 |
| 4,750,639 | 6/1988 | Schaerer | 220/410 |
| 4,763,808 | 8/1988 | Guhl et al. | 220/404 |
| 4,765,579 | 8/1988 | Robbins, III et al. | 248/101 |
| 4,834,253 | 5/1989 | Crine | 220/23.4 |
| 4,834,260 | 5/1989 | Auten | 220/404 |
| 4,834,262 | 5/1989 | Reed | 220/404 |
| 4,856,675 | 8/1989 | Palazzola | 220/404 |
| 4,867,328 | 9/1989 | McCarthy | 220/909 X |
| 4,867,328 | 9/1989 | McCarthy | 220/1T |
| 4,874,111 | 10/1989 | Heller | 220/404 |
| 4,905,853 | 3/1990 | Strawder | 220/523 |
| 4,964,523 | 10/1990 | Bieltvedt et al. | 220/909 X |

*Primary Examiner*—Stephen Marcus
*Assistant Examiner*—Stephen Cronin

[57] ABSTRACT

A receptacle having a rim, at its upper end, provided with a plurality of projections that extend upward from the rim's surface. There are dividers extending across the upper end of the receptacle to divide it into compartments. The projections are spaced around the surface of the rim for the purpose of supporting a number of flexible bags, with one bag in each compartment.

8 Claims, 1 Drawing Sheet

BAG SUPPORT FOR TRASH CANS

RELATED APPLICATIONS

This application is a continuation-in-part of my prior copending application Ser. No. 07/307,912, filed Feb. 9, 1989, Titled Compartmented Receptacle.

BACKGROUND OF THE INVENTION

The prior art shows a trash can with a divider to divide the can into separate compartments, so that different forms of trash may be segregated. Sosower U.S. Pat. No. 4,750,638 shows such an arrangement with a plastic bag in each compartment and with clips of inverted U-shape for attaching the bag to the can.

SUMMARY OF THE INVENTION

My invention provides a new receptacle for separating waste products for recycling, and is simple to make and use.

The invention employs a receptacle, having a bottom and sidewalls that extend upward and terminate at the upper end into a rim. Projections or hooks spaced around the rim, extend upward, and protrude above the rim surface for the purpose of supporting a flexible bag within the receptacle. The spacing of the projections around the rim's surface and the number of projections in the rim's surface determines:

a. The shape of each bag (compartment),
b. The size of each bag (compartment),
c. The number of bags (compartments) per receptacle, and allows the user to vary the above for a particular need. The receptacle may be cylindrical rather than polygonal if so desired.

A swiveling or swinging lid is used to cover each bag (compartment). To do this a divider is supported on the rim (on the sidewall) of the receptacle. The dividers and rim may have a groove in their surfaces to support pins on the lid. This allows the lid to rotate about an axis that is coaxial with the pins, so that waste products may be inserted into the receptacle.

DETAILED DESCRIPTION OF THE DRAWINGS

Figure 1:
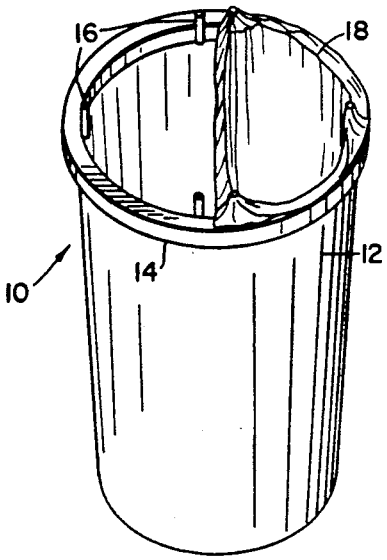
FIG. 1 is a perspective view of a cylindrical receptacle with one bag in place.

In the form of the invention shown in FIG. 1 a cylindrical receptacle 10 has a rim 14 and sidewalls 12, with projections 16 extending above the rim 14, with a flexible bag 18 held by projections such as 16. The receptacle has six projections 16, three of which, on the left hand side of the receptacle, are shown. Three other complementary projections 16 are under the bag 18 each of which is positioned 180 degrees along the upper surface of the receptacle from its complementary pin 16 on the left side of the receptacle.

Figure 2:
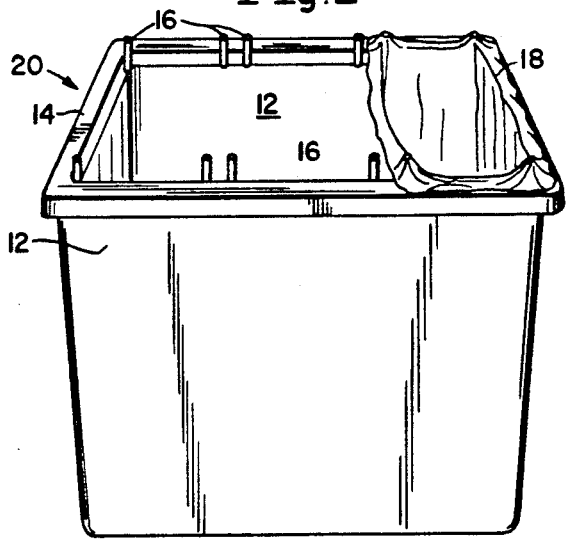
FIG. 2 is a perspective view of a rectangular receptacle with one bag in place and two empty compartments.
Figure 3:
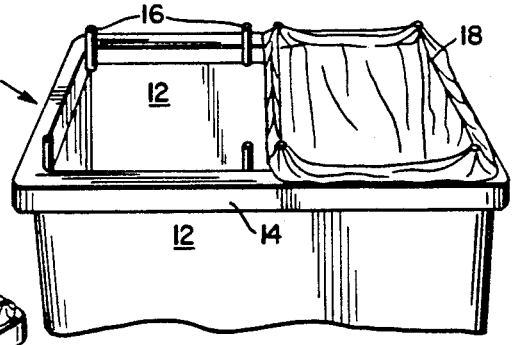
FIG. 3 is a perspective view of a receptacle similar to FIG. 2 except that it has provision to receive only two bags.

FIG. 2 shows a rectangular receptacle 20 having pins 16 for holding three plastic bags 18. Eight pins 16 are shown in FIG. 2. The other four pins are projecting upward from the receptacle at the four corners of bag 18 to support the bag. FIG. 3 is the same as FIG. 2 except it has only eight projections and will receive only two bags.

Figure 4:
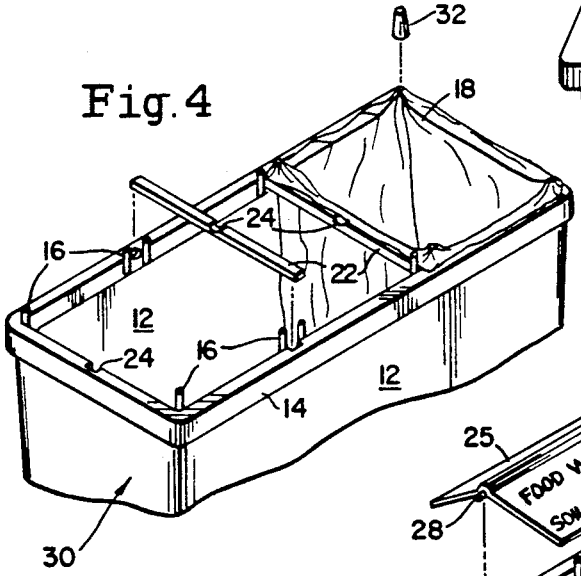
FIG. 4 is a perspective view of a receptacle with three compartments and two dividers in place.
Figure 5:
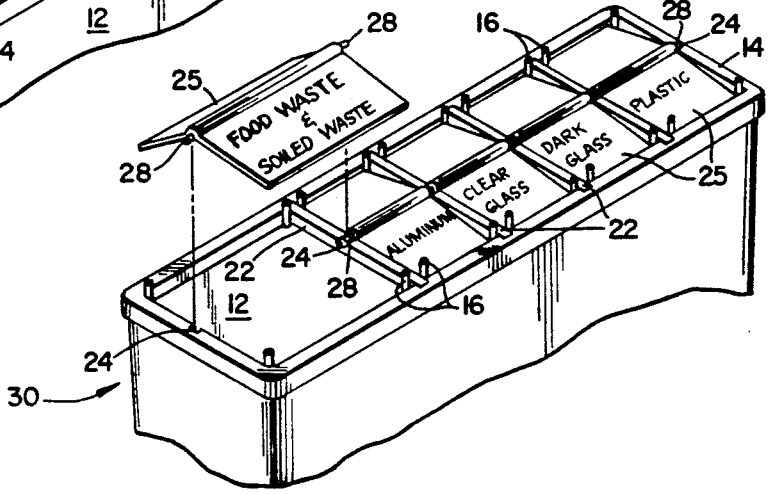
FIG. 5 is a perspective view of a receptacle with five compartments and five bags.

FIGS. 4 and 5 shows receptacles 30 with projections 16 around the rim 14. Divider bars 22 are supported by the rim 14 with a groove 24 in its surface. The receptacle 30, or the rim 14, also has a groove 24 in its upper surface to support hinge pins 28 on lid 25. Hence, each flexible bag 18 defines a compartment. Each lid 25 is labeled with a product name or sign to inform the user of the product it is to receive. The lid 25 may be rotated by the user to open the lid as the waste products are inserted in a compartment.

The vertical pins 16 in all forms of the invention, may support the thin flexible plastic bags in any of several ways. For example, a portion of a plastic bag 18 may be forced down around a pin so as to cause the pin 16 to perforate the bag 18. This would be done as to all three pins 16 of one half of FIG. 1, or a set of four pins 16 in FIGS. 2 to 5. As another example, instead of pins 16 perforating the bag 18, the bag 18 may be draped over the pins 16, as shown in FIGS. 2 to 4, and caps 32 inserted onto the pins with a portion of each bag held between the outside of each pin and the inside of each cap. A single cap is shown in FIG. 4.

The receptacle 12 and 30 have a bottom which rests on the floor, the ground, or the like and have generally vertical sidewalls 12 terminating in an upper end or rim 14.

I claim to have invented:

1. Apparatus for positioning a plurality of flexible bags adjacent to each other, comprising:

support means in the form of a receptacle terminating in an upper open end for positioning at least first and second bags of flexible material, adjacent to each other, with the upper end of each of said first and second bags open, said support means including projections adjacent said upper end, and extending generally vertically above and away from said upper open end of said support means, for engaging said flexible bags and holding such bags in place, first and second rotatable lids for said first and second bags, respectively, each said lid at least partially closing the open upper end of its complementary bag when such bag is positioned in said support means, and means for mounting said rotatable lids by the upper end of said support means, each of said lids being rotatable to a position at which objects may be inserted into the bag complementary to the lid, a divider positioned between said first and second bags, said divider having a top surface, said support means having two end walls, said end walls having a top surface, said end walls and said divider each having a groove in its top surface, said grooves being positioned along a substantially straight line, said means for mounting said rotatable lids comprising a shaft that rides in said grooves.

2. Apparatus as defined in claim 1 in which there are at least three such projections at said upper open end, said projections comprising means for holding three spaced portions of a bag in three different locations so that the bag is held with its upper end open.

3. Apparatus as defined in claim 1 in which said support means is a receptacle having an upper end, at least two groups of projections, with each group comprising at least three projections, each said group of projections comprising means for holding the upper end of a flexible bag open and for holding the bag in place in the receptacle, said groups being positioned so that the bags held by them are adjacent to each other in the receptacle.

4. Apparatus as defined in claim 3 in which the upper end of the receptacle is rectangular in a horizontal plane, each said group of projections having at least four projections extending vertically away from the upper end of the receptacle.

5. Apparatus for positioning a plurality of flexible bags adjacent to each other, comprising support means in the form of a receptacle terminating in an upper open end for positioning at least first and second bags of flexible material, adjacent to each other, with the upper end of each of said first and second bags open, said support means including projections adjacent said upper end, and extending generally vertically above and away from said upper open end of said support means, for engaging said flexible bags and holding such bags in place, first and second rotatable lids for said first and second bags, respectively, each said lid at least partially closing the open upper end of its complementary bag when such bag is positioned in said support means, and means for mounting said rotatable lids by the upper end of said support means, each of said lids being rotatable to a position at which objects may be inserted into the bag complementary to the lid, at least two groups of projections, with each group comprising at least three projections, each said group comprising means for holding the upper end of a flexible bag open and for holding the bag in place in the receptacle, said groups being positioned so that the bags held by them are adjacent to each other in the receptacle, the upper end of the receptacle being rectangular in a horizontal plane, each said group having at least four projections extending vertically away from the upper end of the receptacle, and a divider located between bags positioned in said receptacle, said receptacle and said divider defining grooves at said upper open end, and a lid including a support shaft rotatable in said grooves.

6. Apparatus for positioning a plurality of flexible bags adjacent to each other, comprising:

support means in the form of a receptacle terminating in an upper open end for positioning at least first and second bags of flexible material, adjacent to each other, with the upper end of each of said first and second bags open, said support means including projections adjacent said upper end, and extending generally vertically above and away from said upper open end of said support means for engaging said flexible bags and holding such bags in place, first and second rotatable lids for said first and second bags, respectively, each said lid at least partially closing the open upper end of its complementary bag when such bag is positioned in said support means, and means for mounting said rotatable lids by the upper end of said support means, each of said lids being rotatable to a position at which objects may be inserted into the bag complementary to the lid, each of said lids including a shaft, said support means defining grooves in which said shafts may rotate.

7. Apparatus for positioning a plurality of flexible bags adjacent to each other, comprising:

support means in the form of a receptacle terminating in an upper open end for positioning at least first and second bags of flexible material, adjacent to each other, with the upper end of each of said first and second bags open, said support means including projections adjacent said upper end, and extending generally vertically above and away from said upper open end of said support means, for engaging said flexible bags and holding such bags in place, first and second rotatable lids for said first and second bags, respectively, each said lid at least partially closing the open upper end of its complementary bag when such bag is positioned in said support means, and means for mounting said rotatable lids by the upper end of said support means, each of said lids being rotatable to a position at which objects may be inserted into the bag complementary to the lid.

said lids having a closed position and said projections extending to a level higher than said lids when the lids are closed.

8. Apparatus for positioning a plurality of flexible bags adjacent to each other, comprising:

support means in the form of a receptacle terminating in an upper open end for positioning at least first and second bags of flexible material, adjacent to each other, with the upper end of each of said first and second bags open, said support means including projections adjacent said upper end, and extending generally vertically above and away from said upper open end of said support means, for engaging said flexible bags and holding such bags i place, first and second rotatable lids for said first and second bags, respectively, each said lid at least partially closing the open upper end of its complementary bag when such bag is positioned in said support means, and means for mounting said rotatable lids by the upper end of said support means, each of said lids being rotatable to a position at which objects may be inserted into the bag complementary to the lid.

said support means including a divider for separating said bags, at least one of said lids having a shaft for supporting such lid, said divider and said support means each defining at least one groove in which said shaft may rotate.

* * * * *